US011859464B2

(12) United States Patent
Pang et al.

(10) Patent No.: US 11,859,464 B2
(45) Date of Patent: Jan. 2, 2024

(54) SYSTEM AND METHOD FOR OFFLINE CEMENTING IN BATCH DRILLING

(71) Applicant: SPM Oil & Gas PC LLC, Fort Worth, TX (US)

(72) Inventors: Ray Dicksang Pang, Missouri City, TX (US); Phu Duc Sy Dong, Houston, TX (US); Moises Nava, Houston, TX (US); Russell Hamilton, Houston, TX (US)

(73) Assignee: SPM Oil & Gas PC LLC, Fort Worth, TX (US)

( * ) Notice: Subject to any disclaimer, the term of this patent is extended or adjusted under 35 U.S.C. 154(b) by 140 days.

(21) Appl. No.: 17/601,703

(22) PCT Filed: Apr. 4, 2020

(86) PCT No.: PCT/US2020/026774
§ 371 (c)(1),
(2) Date: Oct. 5, 2021

(87) PCT Pub. No.: WO2020/206393
PCT Pub. Date: Oct. 8, 2020

(65) Prior Publication Data

US 2022/0213759 A1 Jul. 7, 2022

Related U.S. Application Data

(60) Provisional application No. 62/830,163, filed on Apr. 5, 2019.

(51) Int. Cl.
*E21B 33/14* (2006.01)
*E21B 17/02* (2006.01)
(Continued)

(52) U.S. Cl.
CPC ..... *E21B 33/14* (2013.01); *E21B 17/02* (2013.01); *E21B 33/04* (2013.01); *E21B 34/06* (2013.01); *E21B 2200/04* (2020.05)

(58) Field of Classification Search
CPC ..... E21B 33/14; E21B 17/02; E21B 33/04; E21B 34/06; E21B 2200/047; E21B 33/05
See application file for complete search history.

(56) References Cited

U.S. PATENT DOCUMENTS 4,474,236 A * 10/1984 Kellett ..... E21B 33/047 166/341
5,441,310 A 8/1995 Barrett
(Continued)

FOREIGN PATENT DOCUMENTS

WO 2020206393 A1 10/2020

*Primary Examiner* — Brad Harcourt

(57) ABSTRACT

What is described is a system and method for offline cementing of a casing hanger and a casing placed in a wellbore of a well. The system includes an isolation sleeve/cementing spool that is configured for engaging the casing hanger, where the isolation sleeve has at least one access port in fluid communication with an annulus formed by the casing in the wellbore. A dummy hanger is housed within the isolation sleeve and is configured for coupling with the casing hanger and is further in fluid communication with the casing. A valve is configured for coupling to the isolation sleeve and is configured to be in fluid communication with the dummy hanger. A quick connector is coupled to the valve and enables quick coupling of a cementing head.

15 Claims, 6 Drawing Sheets

(51) Int. Cl.
*E21B 33/04* (2006.01)
*E21B 34/06* (2006.01)

(56) References Cited

U.S. PATENT DOCUMENTS

| | | | | |
|---|---|---|---|---|
| 2002/0011336 | A1* | 1/2002 | Baskett | E21B 33/043 166/88.4 |
| 2002/0070545 | A1 | 6/2002 | Meek | |
| 2003/0205385 | A1 | 11/2003 | Duhn | |
| 2005/0082066 | A1 | 4/2005 | Mcguire | |
| 2012/0012341 | A1* | 1/2012 | White | E21B 33/12 166/85.1 |
| 2015/0090450 | A1 | 4/2015 | Thiessen | |
| 2018/0274321 | A1* | 9/2018 | Arefi | E21B 33/14 |

* cited by examiner

SYSTEM AND METHOD FOR OFFLINE CEMENTING IN BATCH DRILLING

CROSS-REFERENCE TO RELATED APPLICATION

This application is a national phase application of Patent Cooperation Treaty Application No. PCT/US2020/026774 filed Apr. 4, 2020, which claims priority to U.S. Provisional Application No. 62/830,163 filed Apr. 5, 2019, which is incorporated herein by reference in their entirety.

FIELD

The present disclosure relates to oil and gas well drilling and production, and in particular, to a system and method for offline cementing in batch drilling.

BACKGROUND

Rigs are used to drive and rotate a drill string with a drilling bit attached at its end to create a well in the ground. The same rig is also used for a second purpose to place casing in the well to provide a conduit from the surface to the producing formation. After a well bore has been drilled and lined with casing, the usual practice is to cement the casing in place to protect ground water and the integrity and stability of the well. Conventional cementing techniques involve displacing cement slurry down through the bore of the casing and out a shoe on the bottom thereof so that the cement fills the annulus between the casing and the well bore wall.

DETAILED DESCRIPTION

Figure 7:
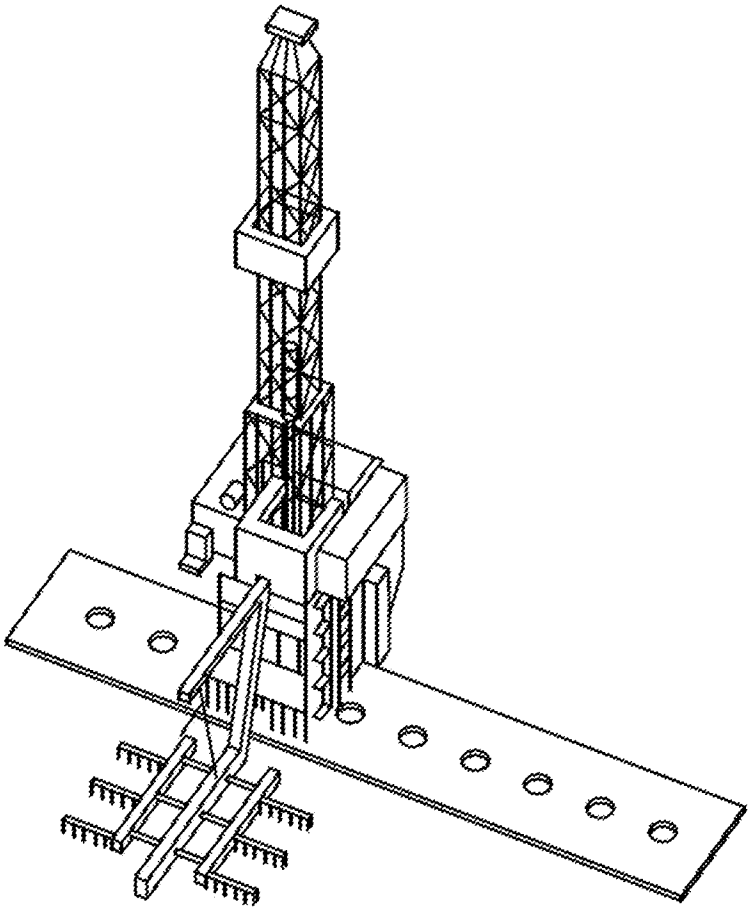
FIGS. 6 and 7 are illustrations of batch drilling rig setups.
Figure 6:
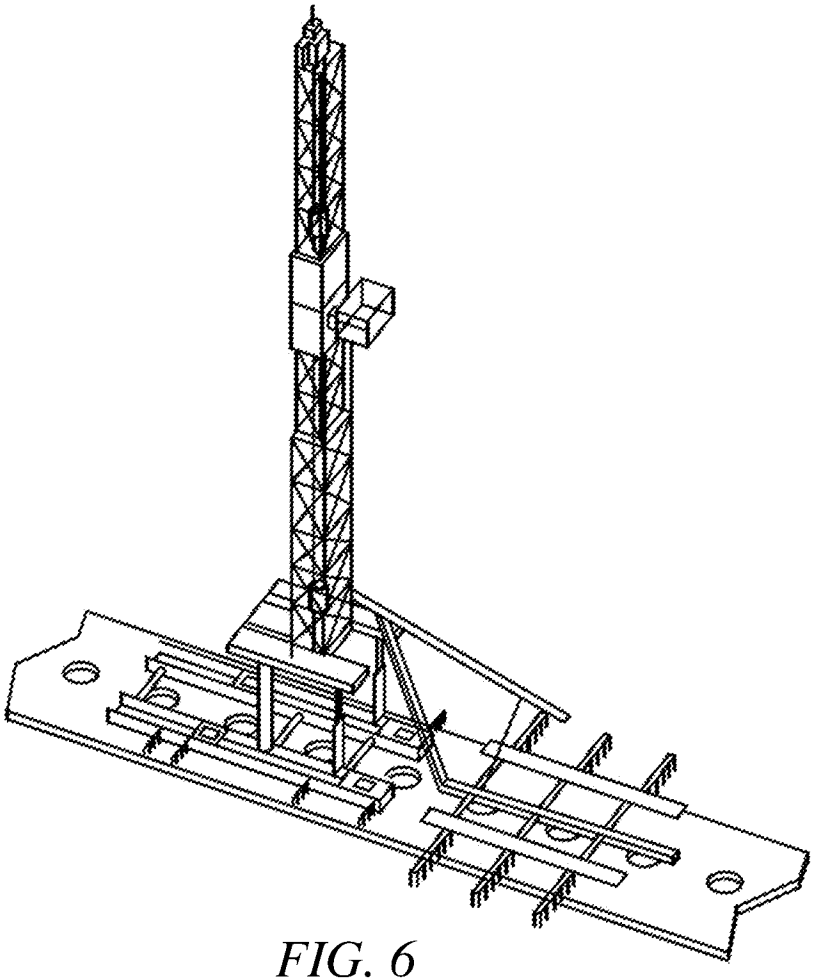

Many techniques and tools have been developed to perform batch drilling. This methodology involves moving a rig to successive locations on the same pad site to drill multiple wells, as shown in FIGS. 6 and 7. Batch drilling enables the subsequent cementing process at each well to be performed "offline," i.e., without the rig in place because it has moved to the next well site. By taking (surface/intermediate/production) casing cementing off of the critical path of the drilling rig, the overall cycle time is significantly reduced to realize cost savings. Currently, there is no intermediate casing mechanical barrier at surface during offline cementing operations as the rig is moved off of the well to resume batch drilling the next well. Therefore, there are significant health and safety risks to personnel when no barrier safeguards are provided at the surface. It is thus desirable to develop a new mechanical wellhead barrier that can quickly interface with the cement head when surface, intermediate and production casings are being installed that will be a standardized device for batch drilling and offline cementing operations.

To drill the well to surface, intermediate or production depth with the drilling rig, a blowout preventer (BOP) is installed on the wellhead. A BOP (not explicitly shown) is a valve assembly that encases the wellhead at the surface. It includes a series of valves, rams, and seals that restrict the pressurized wellbore fluid from breaching the well and getting to the surface. The BOP is typically left in place during the cementing process as the rig is moved away to the next well site.

Figure 1:
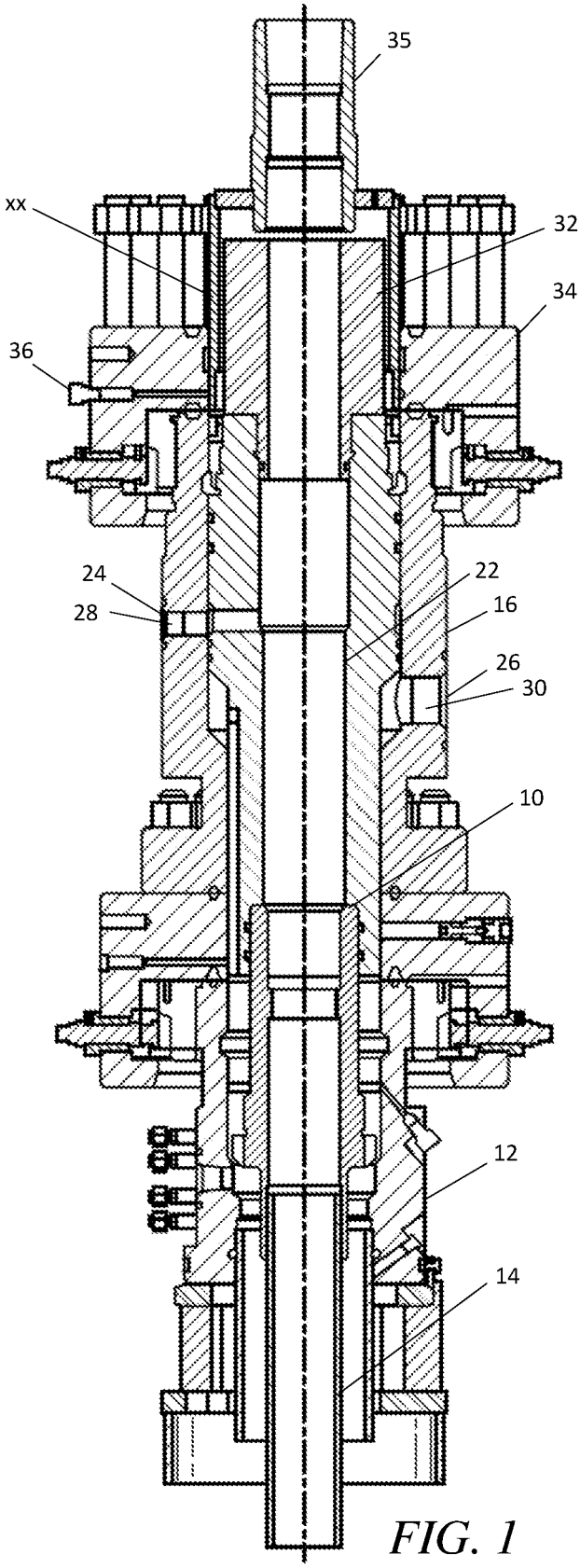
FIG. 1 is a cross-sectional view of an example embodiment of a system for offline cementing in batch drilling according to the teachings of the present disclosure.

As shown in FIG. 1, a casing hanger 10 is installed on the well casing support shoulder 12 or casing head. The casing hanger 10 is used to support, surface or intermediate casing 14 that is inserted and dropped into the well. An isolation sleeve 16 is then installed on top of the casing hanger 10 and a lock ring is engaged using a running tool. The isolation sleeve 16, also referred to as the cementing spool, includes a dummy hanger 22 that is in fluid communication with the casing hanger 10 and the casing 14 in the wellbore. The isolation sleeve/cementing spool 16 further has an inlet 24 and an outlet 26 that provides access to the bore annulus. Valves 28 and 30, such as wing valves, are disposed at the cement inlet 24 and outlet 26 to control cement flow. The isolation sleeve/cementing spool 16 enables the cementing process to be performed offline by providing a pressure control interface at the wellhead. A TIW (ball-type) valve 32 is installed atop the isolation sleeve/cementing spool 16 with a quick connector 34 (see FIG. 4) that enables the use of low torque drive screws 36 to quickly secure a conduit 35 to the cementing head (not explicitly shown) thereon to inject the cementing slurry down the well and up the annulus to affix the casing in place.

Figure 4:
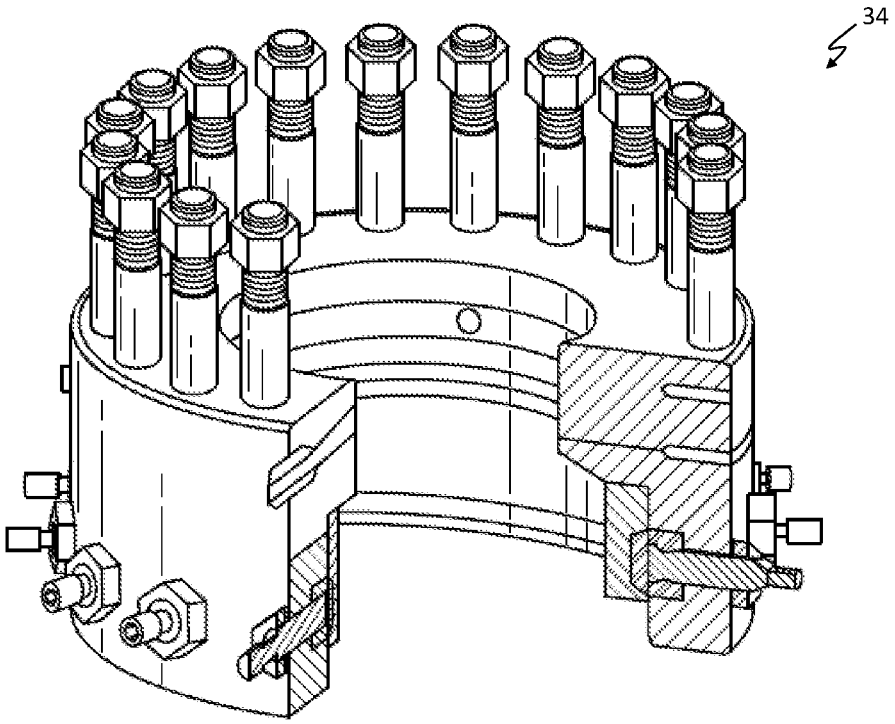
FIG. 4 is a perspective view of an example embodiment of a quick connector according to the teachings of the present disclosure.

The quick connector 34 shown in FIG. 4 is preferably a Weir® Quick Connector (WQC) or a quick connect BOP adapter, that is designed to provide a mechanism for connecting the BOP to the wellhead. This quick connector speeds up the process of connecting to the wellhead to provide a safer and more reliable way to provide a pressure-tight metal seal between critical service equipment. The body of the quick connector provides robust guidance onto the wellhead and simplifies this operation.

Figure 2:
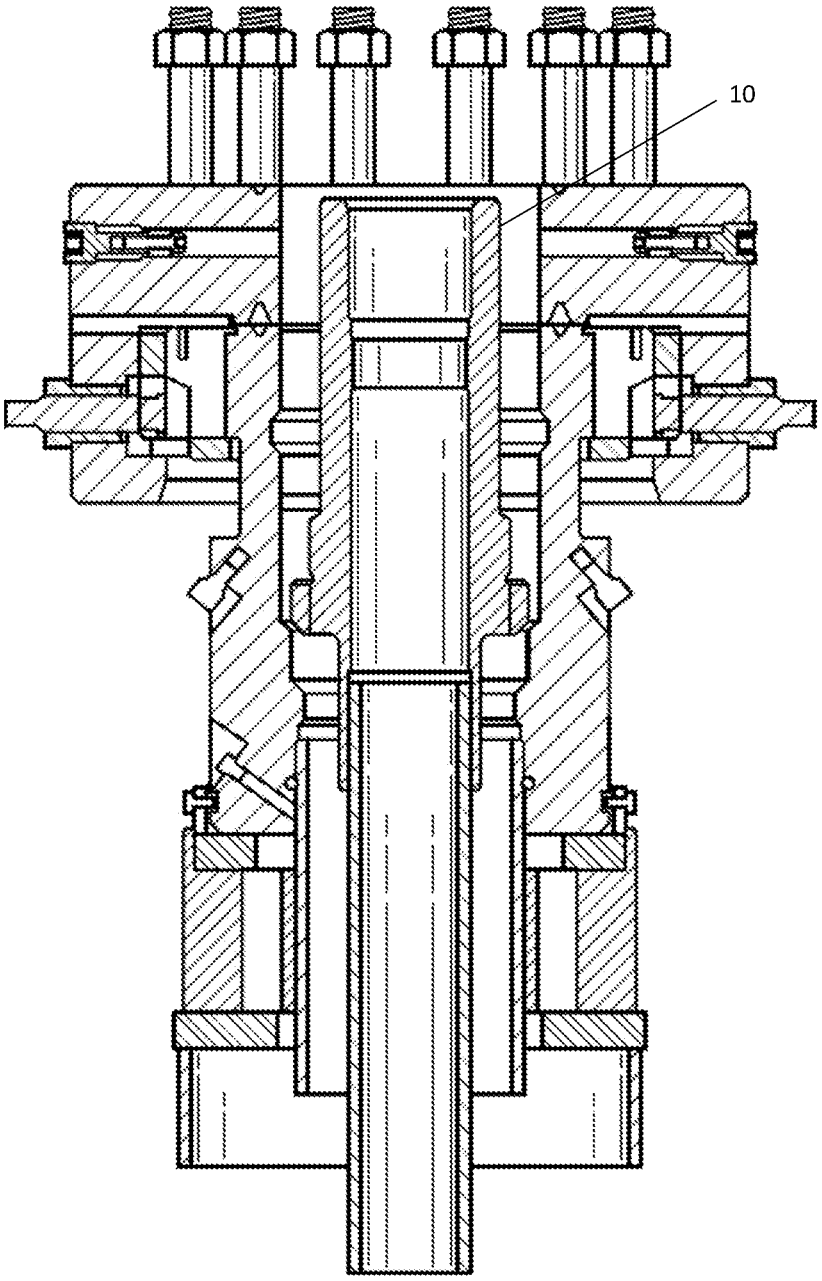
FIGS. 2 and 3 are cross-sectional views of an example embodiment of a well casing post-cementing according to the teachings of the present disclosure.
Figure 3:
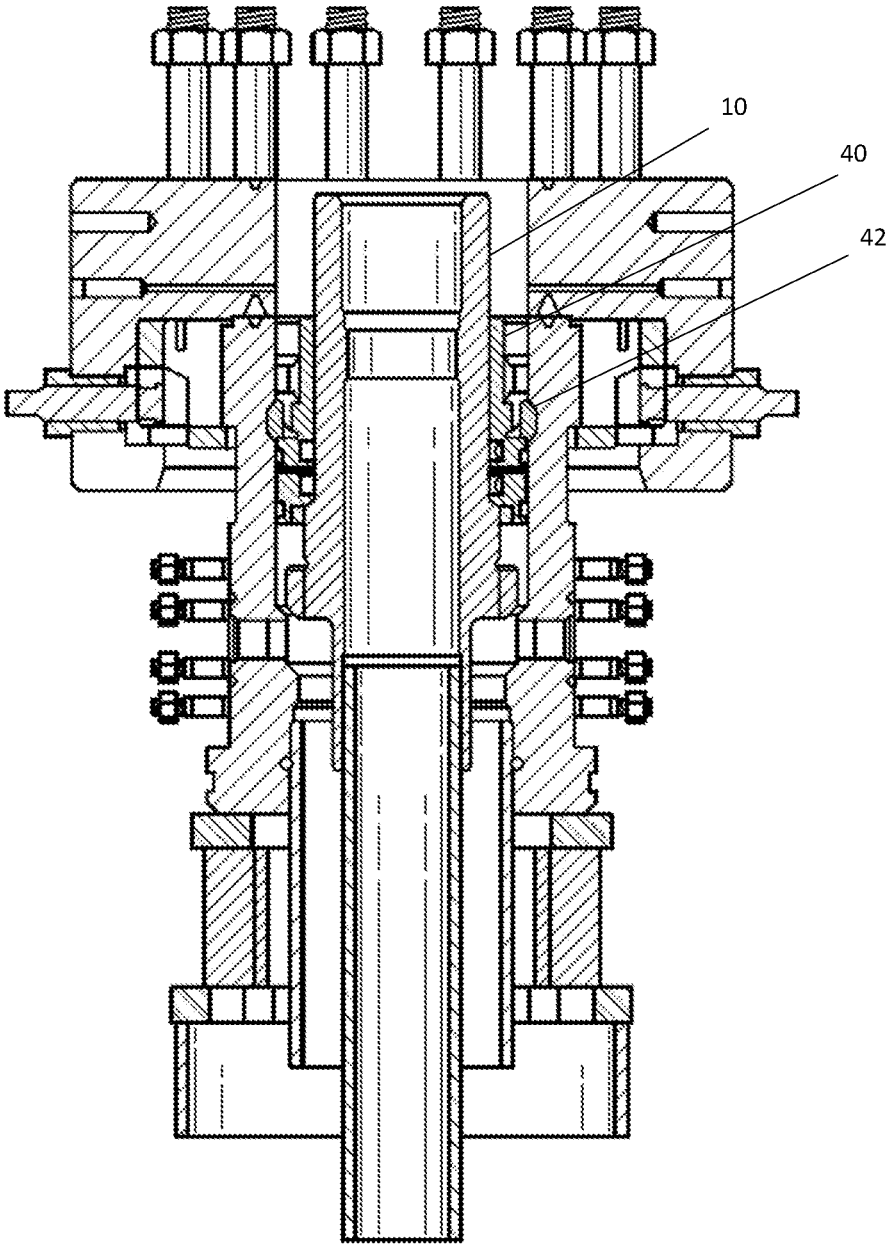
Figure 5:
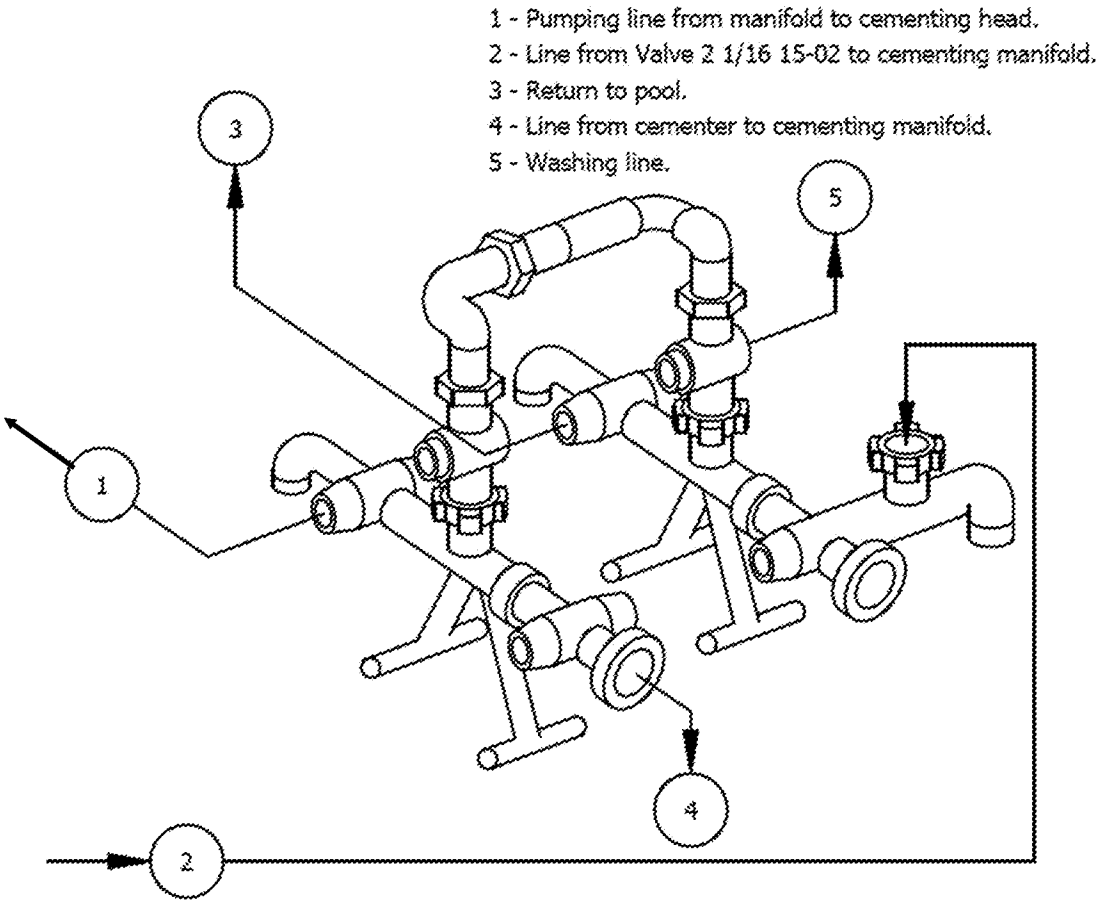
FIG. 5 is an illustration of a cementing setup.

FIG. 5 is an illustration of an exemplary cementing setup. To perform offline cementing, the casing hanger 10 is placed in position on the support shoulder 12. The isolation sleeve 16 is then landed on top of the casing hanger 10 and the lock ring is engaged. The TIW valve 32 is installed. Offline cementing proceeds. At the completion of the cementing process including the installation of the cement plug, the cementing head is removed, the TIW valve 32 is dosed, and the blowout preventer (BOP) stack can be safely nippled down (taken apart and removed). Referring to FIGS. 2 and 3, after the cementing process is completed, the cementing spool/isolation sleeve 16 and cementing head are removed. A primary seal 40 is then installed and the lock ring 42 is engaged to secure the primary seal 40 in place. A back pressure valve (BPV) is then installed in the casing hanger 10.

Some of the desirable characteristics of the system described herein include: 1) provide a mechanical barrier at surface; 2) can be set and removed without use of the rig or wireline; 3) the ability to interface with, e.g., 5½", 7⅝", 8⅝", 9⅝", and 13⅜" casings; 4) interface with offline cementing operations; and 5) ease of installation and removal resulting in time savings.

The drilling and cementing procedure according to the present disclosure can be generalized as follows:

1) Spudding: Drill a cellar up to the depth of 15 ft to provide a pathway for wellhead equipment and casing strings to be running pipe in the hole (RIH).

2) Drill another larger hole (Conductor hole) AND RIH conductor pipe through the cellar by hammering.

3) Use a pilot bit to drill smaller diameter of the hole so that the larger bit cannot get slippage.

4) 1st Stage: Continue the drilling further to the depth of surface casing (20" O.D) and RIH surface casing with casing head housing (CHH).

5) Cement in place the surface casing.

6) 2nd Stage: Drilling continues to the depth of intermediate casing (13⅜ ") and RIH intermediate casing.

7) Set Casing Head Spool (CHS) on Casing head housing and cement in place. Run casing hanger on CHS.

8) 3rd Stage: Continue the drilling process up to the depth of production casing (9⅝") and run casing hanger. Cement the casing and RIH tubing hanger setting (THS) on CHS and perforate (optional: if required).

9) 4th Stage: Run tubing components and space out (pull out of the hole (POOH) the assembly to add the length of pipes i.e. adding spacers) to meet the required length of string.

10) Run tubing with tubing hanger on THS.

11) Set Packer.

12) Set BPV (Back Pressure Valve) on tubing hanger.

13) Remove the blowout preventer (BOP) and set X-mas tree.

14) Conduct TCP (Tubing Conveyed Perforation) if perforation not done.

The features of the present invention which are believed to be novel are set forth below with particularity in the appended claims. However, modifications, variations, and changes to the exemplary embodiments described above will be apparent to those skilled in the art, and the system and method described herein thus encompasses such modifications, variations, and changes and are not limited to the specific embodiments described herein.

What is claimed is:

1. A system for offline cementing of a casing hanger and a casing placed in a wellbore of a well comprising:

an isolation sleeve having at least one access port in fluid communication with an annulus formed by the casing in the wellbore;

a dummy hanger housed within the isolation sleeve and configured for coupling with the casing hanger and in fluid communication with the casing;

a valve coupled to the isolation sleeve and in fluid communication with the dummy hanger; and a quick connector coupled to the valve and configured to enable quick coupling of a cementing head.

2. The system of claim 1, wherein the valve comprises a ball valve.

3. The system of claim 1, wherein the isolation sleeve comprises a cement inlet port and a cement outlet port.

4. The system of claim 1, wherein the isolation sleeve comprises a cement inlet port with a shut-off valve and a cement outlet port with a shut-off valve.

5. The system of claim 1, wherein the isolation sleeve comprises a cement inlet port with a wing valve and a cement outlet port with a wing valve.

6. The system of claim 1, further comprising a well casing support shoulder disposed over the well and configured for supporting the casing hanger.

7. A system for offline cementing of a casing hanger and a casing placed in a wellbore of a well comprising:

an isolation sleeve having at least one access port in fluid communication with an annulus formed by the casing in the wellbore; and a dummy hanger housed within the isolation sleeve and configured for coupling with the casing hanger and in fluid communication with the casing.

8. The system of claim 7, further comprising:

a valve coupled to the isolation sleeve and in fluid communication with the dummy hanger; and a quick connector coupled to the valve and configured to enable quick coupling of a cementing head.

9. The system of claim 7, wherein the valve comprises a ball valve.

10. The system of claim 7, wherein the isolation sleeve comprises a cement inlet port and a cement outlet port.

11. The system of claim 7, wherein the isolation sleeve comprises a cement inlet port with a shut-off valve and a cement outlet port with a shut-off valve.

12. The system of claim 7, wherein the isolation sleeve comprises a cement inlet port with a wing valve and a cement outlet port with a wing valve.

13. The system of claim 7, further comprising a well casing support shoulder disposed over the well and configured for supporting the casing hanger.

14. A method for offline cementing of a casing placed in a well comprising:

securing an isolation sleeve to a casing support shoulder disposed over the well, the isolation sleeve configured for housing a dummy hanger which is configured for coupling with a casing hanger disposed over the well and in fluid communication with the casing, the isolation sleeve having at least one access port in fluid communication with an annulus formed by the casing in the well;

coupling a ball valve to the isolation sleeve;

proceeding with and completing the cementing process;

closing the ball valve; and nippling down a blowout preventer disposed over the well.

15. The method of claim 14, further comprising:

removing the isolation sleeve;

installing an annular primary seal about the casing hanger; and engaging an annular lock ring about the primary seal.

* * * * *